United States Patent [19]

Smith et al.

[11] 4,135,584

[45] Jan. 23, 1979

[54] BLADE STABILIZING LINKAGE FOR A BULLDOZER

[75] Inventors: Roger M. Smith; Gary P. Freese, both of Joliet, Ill.

[73] Assignee: Caterpillar Tractor Co., Peoria, Ill.

[21] Appl. No.: 834,097

[22] Filed: Sep. 19, 1977

[51] Int. Cl.[2] ..... E02F 3/76

[52] U.S. Cl. ..... 172/804; 172/809

[58] Field of Search ..... 172/801, 803, 804, 805, 172/806, 807, 808, 809

[56] References Cited

U.S. PATENT DOCUMENTS

| | | | |
|---|---|---|---|
| 3,158,944 | 12/1964 | Rehberg | 172/803 |
| 3,661,214 | 5/1972 | Peterson | 172/801 |
| 3,901,329 | 8/1975 | Eftefield | 172/809 |
| 3,941,195 | 3/1976 | Stedman | 172/801 |
| 4,026,368 | 5/1977 | Asal | 172/801 |

*Primary Examiner*—Richard J. Johnson

*Attorney, Agent, or Firm*—Wegner, Stellman, McCord, Wiles & Wood

[57] ABSTRACT

A bulldozer including a vehicle frame, a dozer blade forwardly of the frame, a lift linkage movably secured to the frame and including two spaced arms extending longitudinally of the frame and connected to the blade, at least one motor connected to the frame and to one of the blade and the lift linkage for selectively elevating the blade relative to the frame, and a stabilizing linkage interconnecting the frame and one of the blade and the lift linkage including a first link mounted intermediate its ends on the frame for rotation about an axis extending longitudinally of the frame, and second and third elongated links each having an end pivoted to the first link on opposite sides of the axis and extending in opposite directions therefrom, the other ends of the second and third links being pivoted to one of a corresponding arm and blade.

7 Claims, 3 Drawing Figures

32
10
30
2.
66
3.
28
2.
50
60
52
52
36
38
44
14
12
56
42
54
62
68
24
18
58
34
16
64
3.
20

18
22
68
38
42
44
12
40
36
26
10
28
34
60
62
56
52
52
66
14
24
28
34
58
26
36
38
12
42
44
40
18
16
64
22

BLADE STABILIZING LINKAGE FOR A BULLDOZER

BACKGROUND OF THE INVENTION

This invention relates to earth-working vehicles such as bulldozers, and more specifically, to a blade stabilizing linkage therefor.

The presence of side forces on blades of earth-working vehicles, such as bulldozers, when in operation, and the resultant bending moments imposed on the lift linkage have long been recognized. Typically, a stabilizing linkage is utilized to interconnect the frame of the vehicle and the blade to transfer the sideways directed forces from the lift linkage to the vehicle frame and to limit side sway of the lift linkage which, if permitted to become too great, would result in the lift linkage contacting the bulldozer tracks and being damaged thereby.

The various forms of such stabilizing linkages heretofore known are such that when the blade is elevated with respect to the vehicle frame, it will move in an arcuate path with respect to the side of the vehicle with the consequence that there still must be provision for adequate spacing between the lift linkage and the vehicle tracks and a certain amount of bending moment will be present in the lift linkage requiring the same to be of extremely sturdy and, therefore, expensive, construction.

SUMMARY OF THE INVENTION

The present invention is directed to overcoming one or more of the above problems.

According to the present invention, there is provided a bulldozer including a vehicle frame and a dozer blade forwardly of the frame. A lift linkage is movably secured to the frame and includes two spaced arms extending longitudinally of the frame and connected to the blade. At least one motor means is connected to the frame and to one of the blade and the lift linkage for selectively elevating the blade relative to the frame. A stabilizing means interconnects the frame and one of the blade and the lift linkage and, according to the invention, includes a pivot member mounted forwardly of the frame for rotation about an axis extending generally longitudinally of the frame, and a pair of inextensible members, each being connected to the pivot member on opposite sides of the axis. The inextensible members are relatively movable with respect to the pivot member and further extend in opposite directions therefrom towards respective ones of the arms. The inextensible members are further connected to one of the respective arms in the blade and are movable with respect thereto.

Other objects and advantages will become apparent from the following specification taken in connection with the accompanying drawings.

DESCRIPTION OF THE PREFERRED EMBODIMENT

Figure 1:
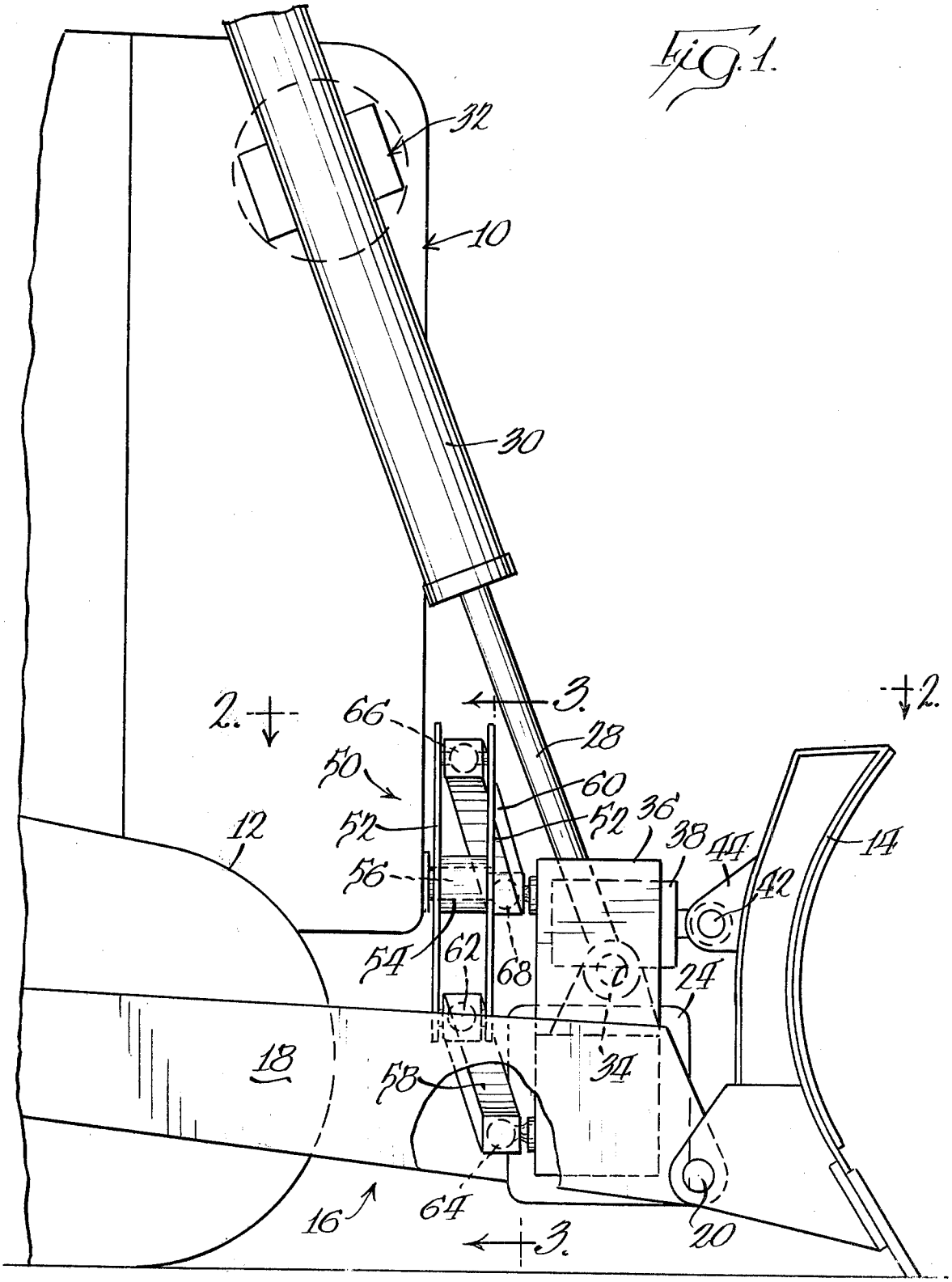
FIG. 1 is a fragmentary, side elevation of a bulldozer embodying a stabilizing linkage made according to the invention.
Figure 2:
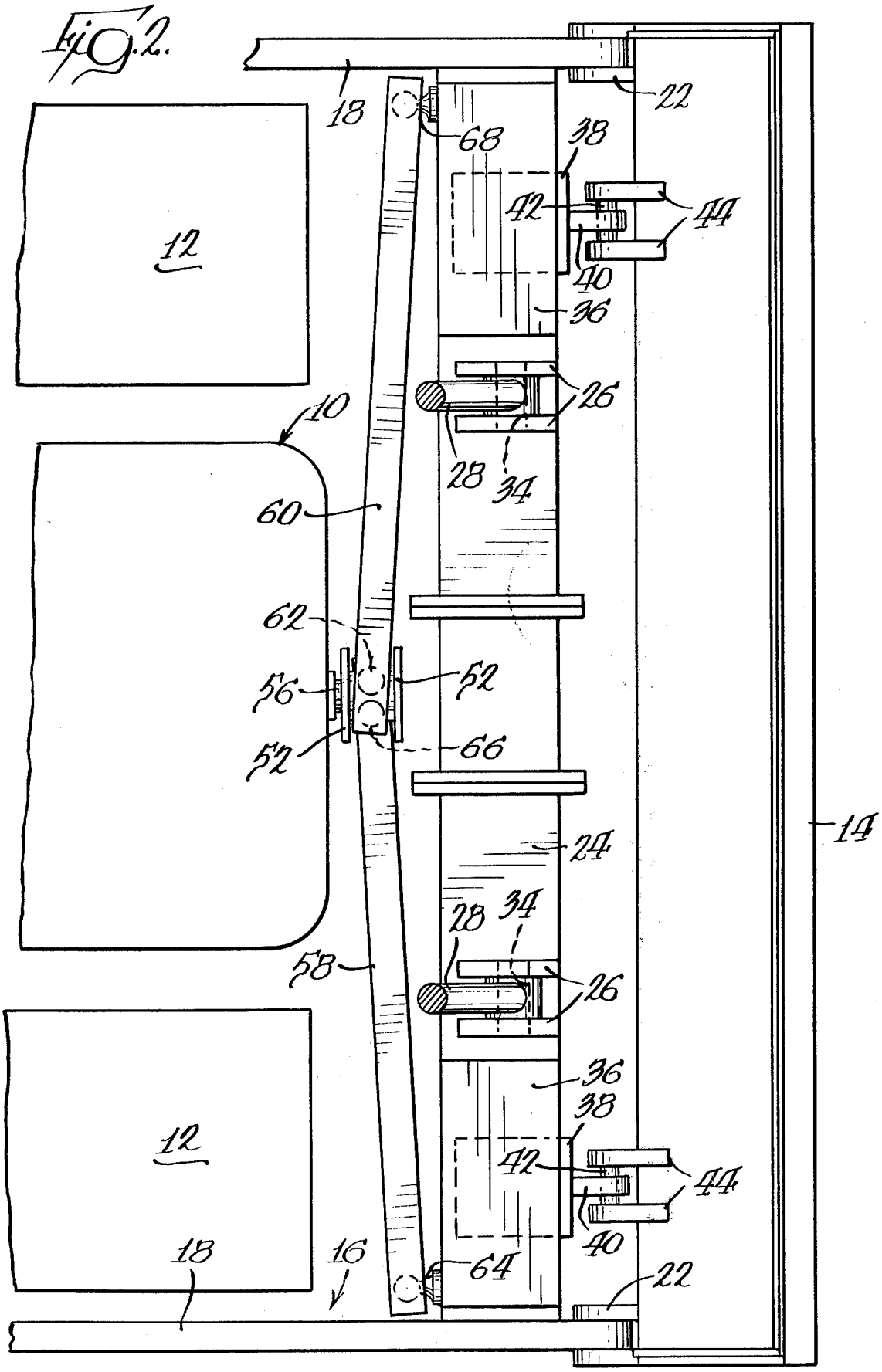
FIG. 2 is a sectional view taken approximately along the line 2—2 of FIG. 1.

An exemplary embodiment of a bulldozer made according to the invention is illustrated in the drawings and, with reference to FIGS. 1 and 2, is seen to include a main vehicle frame, generally designated 10, flanked by crawler-type tracks 12 which are, in turn, mounted on individual track frames (not shown) secured to the main vehicle frame 10 in a customary fashion.

Forwardly of the main frame 10, is a dozer blade 14 and a lift linkage, generally designated 16, is provided therefor. The lift linkage 16 is composed of two, spaced, longitudinally extending arms 18 having their rearward ends (not shown) pivotally connected to the track frames for the tracks 12 in a customary fashion. The forwardmost ends of the arms 18 are connected as by pivots 20 extending through apertures in rearwardly directed yokes 22 on the rear of the dozer blade 14.

A cross member 24 extends between and interconnects the arms 18 and includes spaced, upwardly extending, apertured yokes 26. The yokes 26 receive the rods 28 of hydraulic cylinders 30 (only one of which is shown) which, in turn, are pivotally connected as at 32 in a conventional fashion to the main vehicle frame 10. The rods 28 are pivoted to the yokes 26 by pivot pins 34 and, as a consequence, actuation of the cylinders 30 will cause elevation or lowering of the arms 18 and thus the dozer blade 14.

Near its opposite ends, the cross member 24 mounts upwardly extending towers 36 and the same mount, in a conventional fashion, cushioning devices 38 which may be made according to U.S. Pat. No. 3,148,944, issued Dec. 1, 1964 to Rehberg et al. The cushioning devices 38 each have a forwardly directed shaft 40 terminating in an eye receiving a pin 42 which couples the same to a rearwardly extending yoke 44 on the back of the dozer blade 14. As a consequence, heavy loading of the blade 14 as, for example, when the bulldozer is being utilized in tandem to push a scraper, any abrupt changes in loading of the blade 18 are cushioned by reason of the resultant pivoting of the blade 14 about the pins 20 and against the absorptive resilience of the cushioning devices 38.

The bulldozer includes a blade stabilizing linkage, generally designated 50. As best seen in FIGS. 1 and 2, the linkage 50 includes a first link defined by a pair of spaced apart plates 52 interconnected between their ends by a bushing 54. A forwardly extending stub shaft 56 is mounted on the main frame 10 near the lowermost extremity thereof and extends through the bushing 54 to rotatably mount the first link defined by the plates 52 for rotation about an axis extending generally longitudinally of the vehicle.

Figure 3:
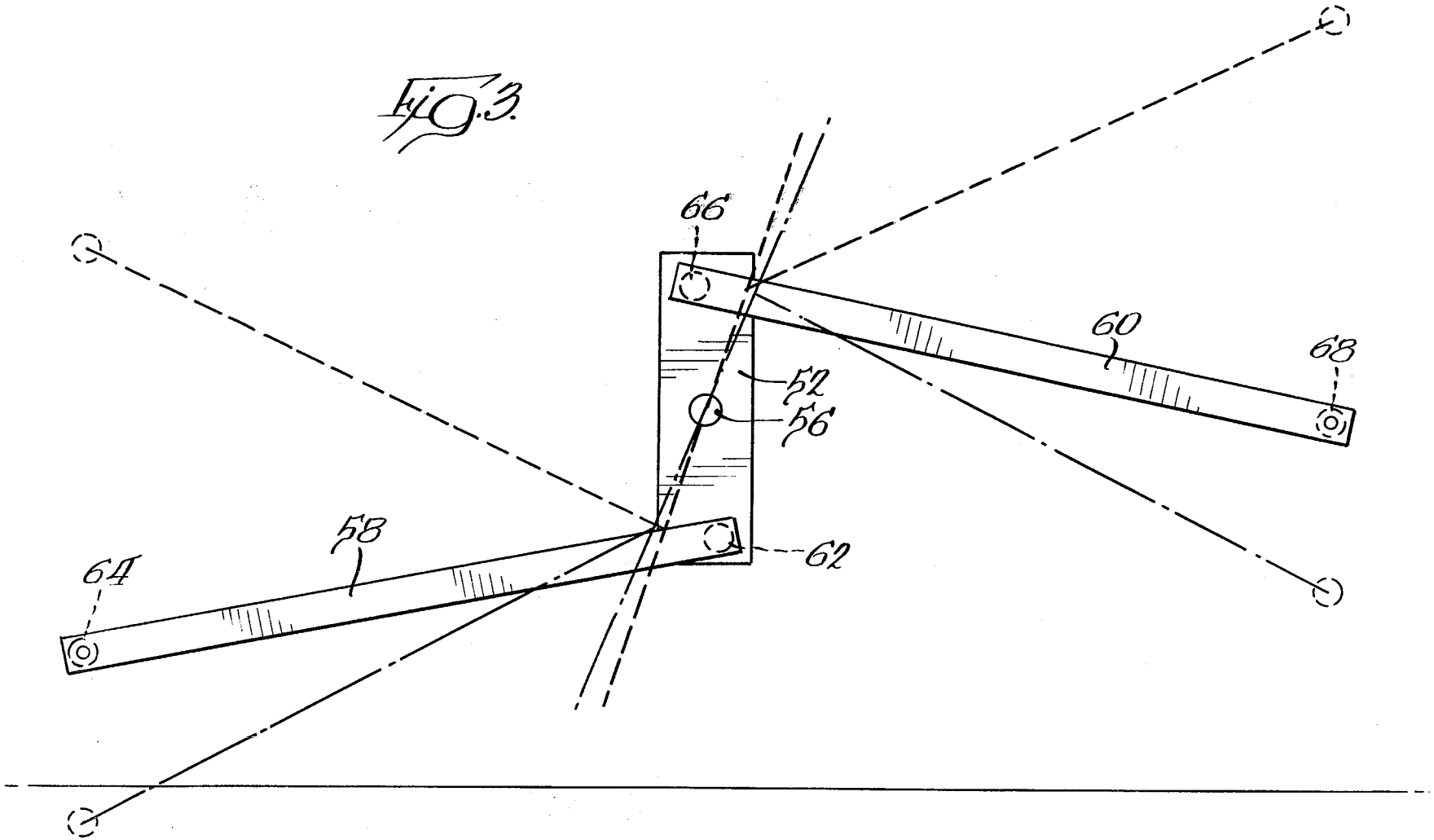
FIG. 3 is a schematic sectional view taken approximately along the line 3—3 of FIG. 1.

As best seen in FIGS. 2 and 3, second and third links 58 and 60 are also provided. The link 58 has one end connected by a ball joint 62 between the plates 52 to the first link defined by those plates. Its opposite end is connected via a ball joint 64 to the cross member 24 adjacent one of the arms 18. The third link 60 has one end connected by a ball joint 66 located between the plates 52 to the plates 52 oppositely of the ball joint 62 with respect to the shaft 56. It is to be observed that the ball joints 62 and 66 are equally spaced from and diametrically located about the shaft 56.

The third link 60 is connected to the left tower 36 by a ball joint 68 and, as can be seen from FIG. 3, wherein the links 58 and 60 are shown in solid lines in the attitude in which they would be with the bulldozer moving across flat terrain and the blade 14 resting on the terrain and not digging thereinto, the arrangement is such that the links 58 and 60 extend in opposite directions from the link defined by the plates 52 and downwardly from their points of connection to the first link at the same angle with respect to the horizontal. In this connection, for the orientation illustrated, the links 58 and 60 should be of equal length.

As a consequence of this construction, should a side load be imposed upon the blade 14 such as to tend to drive the link 58 to the right, as viewed in FIG. 3, it will be appreciated that the resulting force will tend to pivot the first link defined by the plates 52 about the shaft 56 in a counterclockwise direction, thereby tending to move the link 60 to the left, as viewed in FIG. 3. As a consequence, the link 60 will apply a leftward directed force to the blade 14 to offset the rightwardly directed side force applied through the link 58 thereby preventing any substantial sideward movement of the blade 14 as a result of the force.

At the same time, for the various dotted line positions of the link shown in FIG. 3, it will be appreciated that when the blade 14 is raised through operation of the cylinders 30, the ball joints 64 and 68 will each remain in a single vertically extending plane which also extends longitudinally of the vehicle so that there is no side sway of the blade 14 and the same will not move in an arcuate path with respect to the sides of the vehicle during such movement. As a result, the vehicle can be built with minimal clearance between the arms 18 and the tracks 12 since the possibility of interference between the two is eliminated by the unique stabilizing structure. At the same time, because side loads are transmitted to the main frame in the manner mentioned earlier, in many cases, lesser quantities of structural material are required in fabricating the arms 18, thereby minimizing the expense thereof.

The embodiments of the invention in which an exclusive property or privilege is claimed are defined as follows:

1. A bulldozer comprising:

a vehicle frame;

a dozer blade forwardly of said frame;

a lift linkage movably secured to said frame and including two spaced arms extending longitudinally of said frame and connected to said blade;

at least one motor means connected to said frame and to one of said blade and said lift linkage for selectively elevating said blade relative to said frame; and stabilizing means interconnecting said frame and one of said blade and said lift linkage including a first link mounted intermediate its ends on said frame for rotation about an axis extending generally longitudinally of said frame, and second and third elongated links each having an end pivoted to said first link on opposite sides of said axis, and extending in opposite directions therefrom, the other ends of said second and third links being pivoted to one of a corresponding arm and said blade.

2. The bulldozer of claim 1 wherein at least one of said links is swivelly mounted.

3. The bulldozer of claim 2 wherein said first link is mounted for rotation only and said second and third links are swivelly mounted.

4. A bulldozer comprising:

a vehicle frame;

a dozer blade forwardly of said frame;

a lift linkage movably secured to said frame and including two spaced arms extending longitudinally of said frame and connected to said blade;

at least one motor means connected to said frame and to one of said blade and said lift linkage for selectively elevating said blade relative to said frame; and stabilizing means interconnecting said frame and one of said blade and said lift linkage including a pivot member mounted forwardly of said frame for rotation about an axis extending generally longitudinally of said frame, and a pair of inextensible members, each being connected to said pivot member on opposite sides of said axis and being relatively movable with respect thereto and further extending in opposite directions therefrom towards respective ones of said arms, said inextensible members further being connected to one of the respective arms and said blade and movable with respect thereto.

5. The bulldozer of claim 4 wherein said inextensible members comprise rigid links.

6. A bulldozer comprising:

a vehicle frame;

a dozer blade forwardly of said frame;

a lift linkage movably secured to said frame and including two spaced arms extending longitudinally of said frame and connected to said blade;

at least one motor means connected to said frame and to one of said blade and said lift linkage for selectively elevating said blade relative to said frame; and stabilizing means interconnecting said frame and one of said blade and said lift linkage including first, second and third elongated rigid links, said first link being pivotally connected intermediate its ends to said frame at the end thereof nearest said blade for rotation about an axis extending longitudinally of said frame, said second and third links having ends pivotally and swivelly connected to said first link on opposite sides of said axis and at locations substantially equally spaced therefrom, and each having their opposite ends pivotally and swivelly connected to opposite sides of said lift linkage.

7. The bulldozer of claim 6 wherein a cross member interconnects said arms rearwardly of said blade and forwardly of said frame; and said second and third links are pivotally and swivelly connected to said cross members.

* * * * *